US007337649B2

(12) United States Patent
Fidziukiewicz

(10) Patent No.: US 7,337,649 B2
(45) Date of Patent: Mar. 4, 2008

(54) PRESS ACTION SIMULATOR FOR AERIAL CAM SET UP

(75) Inventor: Erich D. Fidziukiewicz, South Lyon, MI (US)

(73) Assignee: Anchor Lamina, Inc., Windsor, Ontario (CA)

( * ) Notice: Subject to any disclaimer, the term of this patent is extended or adjusted under 35 U.S.C. 154(b) by 330 days.

(21) Appl. No.: 10/503,702

(22) PCT Filed: Feb. 11, 2002

(86) PCT No.: PCT/US02/04110

§ 371 (c)(1),
(2), (4) Date: Aug. 5, 2004

(87) PCT Pub. No.: WO03/068429

PCT Pub. Date: Aug. 21, 2003

(65) Prior Publication Data

US 2005/0126254 A1 Jun. 16, 2005

(51) Int. Cl.
*B21J 13/02* (2006.01)

(52) U.S. Cl. ..... 72/452.9; 72/481.1; 72/481.3

(58) Field of Classification Search ..... 72/452.9, 72/315, 481.1, 481.3, 481.4, 481.8; 29/465
See application file for complete search history.

(56) References Cited

U.S. PATENT DOCUMENTS

| | | | | |
|---|---|---|---|---|
| 5,101,705 | A | 4/1992 | Matsuoka | |
| 5,231,907 | A | 8/1993 | Matsuoka | |
| 5,487,296 | A | 1/1996 | Gerhart et al. | |
| 5,884,521 | A * | 3/1999 | Fidziukiewicz | 72/452.9 |
| 5,904,064 | A | 5/1999 | Higuchi | |
| 6,164,115 | A | 12/2000 | Higuchi et al. | |
| 6,220,137 | B1 | 4/2001 | Matsuoka | |
| 2002/0005103 | A1 * | 1/2002 | Ceroll et al. | 83/473 |

* cited by examiner

*Primary Examiner*—Derris H. Banks
*Assistant Examiner*—Debra M Wolfe
(74) *Attorney, Agent, or Firm*—Schnader Harrison Segal & Lewis, LLP

(57) ABSTRACT

Adjustment of the tools (24) on the tool holder (10) in an Aerial Cam of a metal stamping press may be readily effected by opening the press to remove the upper die (14) from the stamping area and then removing the tool holder (10) on the driver (18) for controlled reciprocation simulating normal operation of the press. The tools (24) may then be adjusted in relation to the workpiece without the interference of the press dies (14 and 20).

8 Claims, 6 Drawing Sheets

PRESS ACTION SIMULATOR FOR AERIAL CAM SET UP

BACKGROUND OF THE INVENTION

1. Field of the Invention

This invention relates to the set up of aerial cams in presses for forming sheet metal.

2. Background Art

Aerial cams such as shown in U.S. Pat. Nos. 5,884,521; 5,487,296; 5,101,705 and 5,231,907 have been used for several years in sheet metal stamping operations to facilitate what might be termed secondary operations such as piercing holes, or the deformation of the metal panel (the workpiece) in a fashion that could not be performed by the action of the main dies in the press. The tools which perform such secondary operations are mounted on what is termed a slide, or tool holder, suspended from a cam adapter which is mounted on the upper shoe of the die set. As the upper shoe descends, the slide is carried downwardly and against a driver fastened to the lower die shoe of the press. The angles between the contacting faces of the slide, cam adapter and driver are such that the tool holder is shifted laterally relative to the movement of the press shoes or platens, to carry its tools toward and from the sheet metal being formed. As the upper shoe rises with the opening of the press, the cam adapter causes the slide to shift in the opposite direction to extract its tooling from the sheet metal being formed. Thus, the slide moves to and fro as the upper and lower dies of the press move into and out of the die work area.

Of course it is necessary to adjust the position of the tools on the slide so that they effect the desired secondary operation on the sheet metal being formed in the press. The problem is to effect the necessary adjustment despite the obstruction of the die work area by the press dies.

Heretofore the adjustment has been effected by a trial and error method, i.e., opening the press, adjusting the tools on the slide, closing the press on a workpiece, opening it, checking the action of the tools on the work piece, then readjusting the tools on the slide to correct their action on the workpiece, and closing the press again on another workpiece and then reopening it, and continuing this procedure until the tool position on the slide was acceptable. This trial and error method of adjusting the tools on the slide could take many hours of time by several tool and die operators and inflate the cost of setting up the press. Thus, there has been a long felt need for a method to quickly adjust the tools on the slide or tool holder without the time consuming trial and error method of the prior art.

SUMMARY OF THE INVENTION

My solution to this long standing problem is to open the press, thereby removing the upper die or shoe from the die work area, and then detach the tool holder, or slide, from the cam adapter and mount the slide directly on the driver. Then move the tool holder on the driver as though it was being moved by the cam adapter, thereby replicating its movement when the press is closed and opened. This movement of the tool holder replicates the movement of the slide which occurs as the cam adapter, slide and driver interact during descent and rise of the cam adapter during normal operation of the press. This replication of tool holder movement does not necessarily correspond exactly to the distance of travel of the tool holder movement during operation of the press, but is sufficient to enable adjustment of the tool or tools on the tool holder in relation to the workpiece. Thus, the slide may be moved in a direction to shift the tools carried thereby and the position of the tools relative to the workpiece can be observed, measured and adjusted because there is no obstruction by the upper die or cam adapter. Thus proper adjustment of the tools on the slide may be carried out quickly and accurately as opposed to the prior trial and error method of adjusting the tools.

To accomplish the replication of the tool holder movement, I provide what I have termed an installation bracket which is mounted on the slide or tool holder. Cooperating with the bracket to limit its movement and in turn the movement of the tool holder on the driver, is a key which fits with and is secured to the driver. An adjustment screw or the like extends between the bracket and the key and upon rotation of the screw shifts the bracket and in turn the tool holder on the driver as it would normally move in operation of the press.

DETAILED DESCRIPTION OF THE PREFERRED EMBODIMENT(S)

Figure 1:
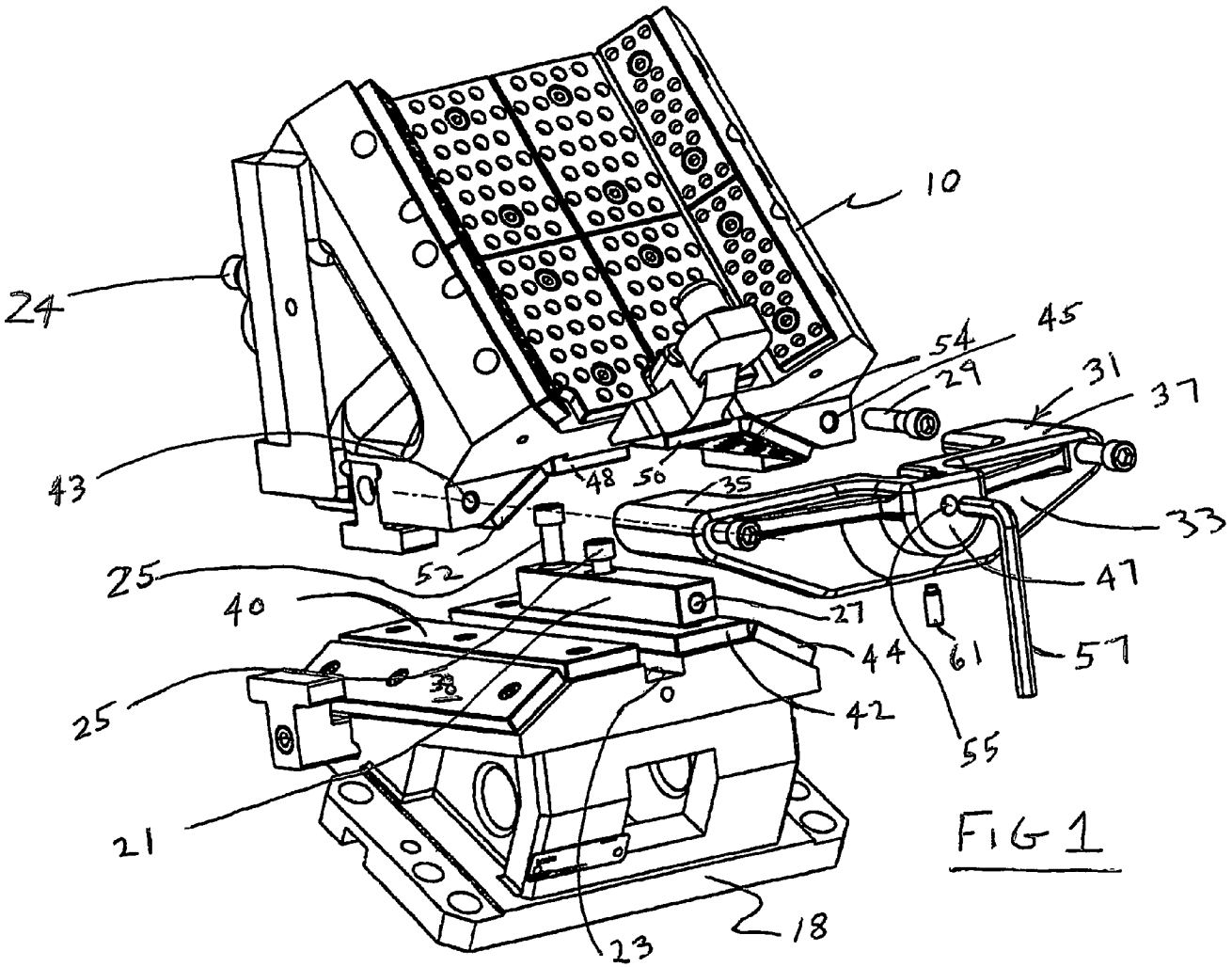
FIG. 1 is an exploded perspective view of the tool holder and driver of an aerial cam with the cam actuator removed and with apparatus for simulating movement of the tool holder during normal operation of the press ready for mounting on the tool holder and driver.
Figure 3:
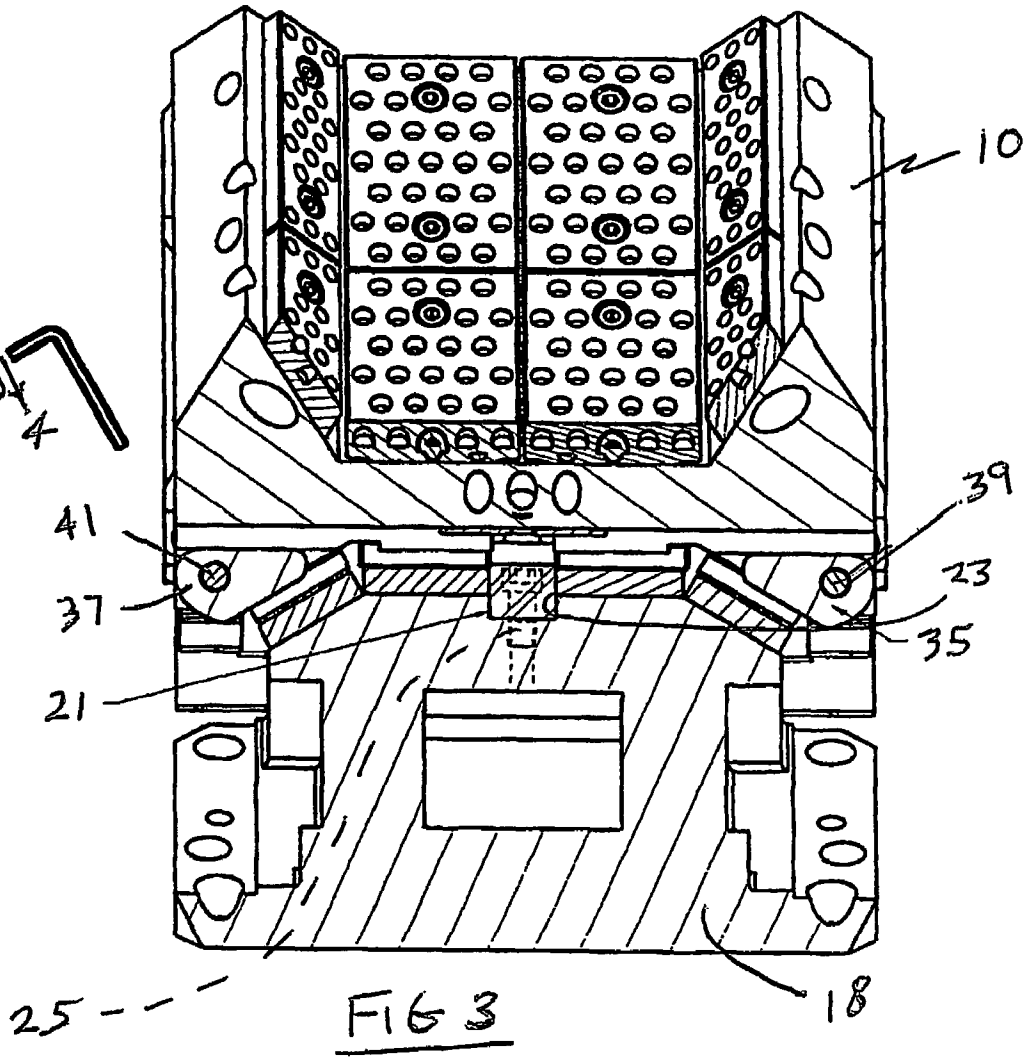
FIG. 3 is a cross-sectional view taken on the line 3-3 of FIG. 2.
Figure 2:
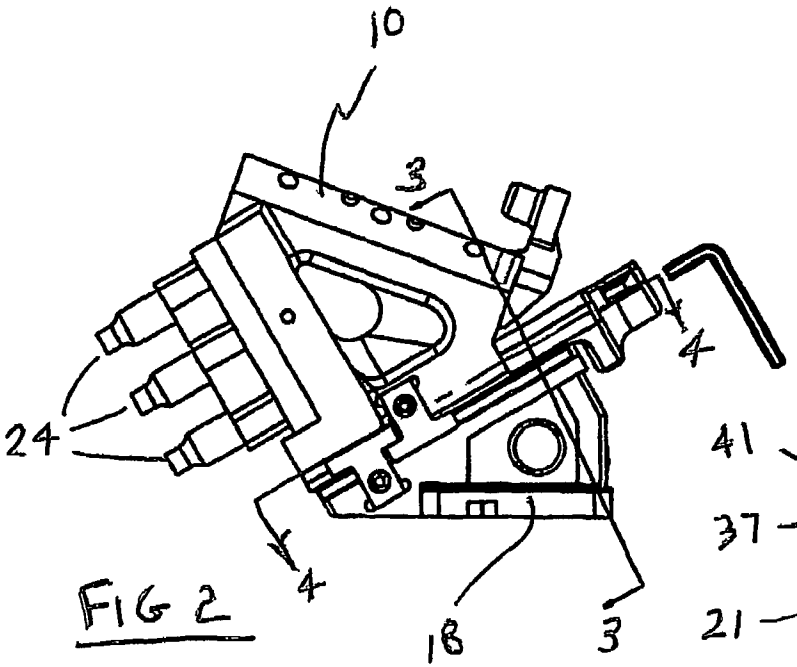
FIG. 2 is a side elevation of the mechanism of FIG. 1, but with the apparatus for simulating movement of the tool holder mounted on the tool holder and driver.

In U.S. Pat. No. 5,884,521, incorporated herein by reference, and hereinafter the —521 patent, an aerial cam is shown in FIGS. 1 and 2 attached to and between the upper shoe or platen 14 of a sheet metal stamping press, and the lower shoe or platen 20. For clarity of illustration the main forming dies of the press are not shown. A portion of the workpiece, WP, is shown on a workpiece holder WPH, and a tool 24 in FIG. 3 of such patent moves against and retracts away from the workpiece upon, respectively, the descent and the rise of the upper shoe 14 of the press. A cam adapter 12 is fastened to the upper shoe to move therewith. Suspended from the cam adapter 12 is a tool holder 10 on which the tool or tools 24 are mounted which cooperate with the workpiece WP. When the press closes, the upper shoe descends and carries the tool holder 10 downwardly until the holder encounters the driver 18, whereupon the tool holder is shifted laterally (in relation to the path of movement of the upper die or shoe 14) to carry the tool or tools 24 against the workpiece WP to perform some action thereon, such as punching one or more holes, deforming the workpiece to provide a tab or indentation thereon, or the like. When the press opens, the upper shoe rises and the tool holder is retracted to remove the tool or tools 24 away from workpiece WP. The tool holder rises with the upper shoe as the press opens removing it from the die work area.

Figure 7:
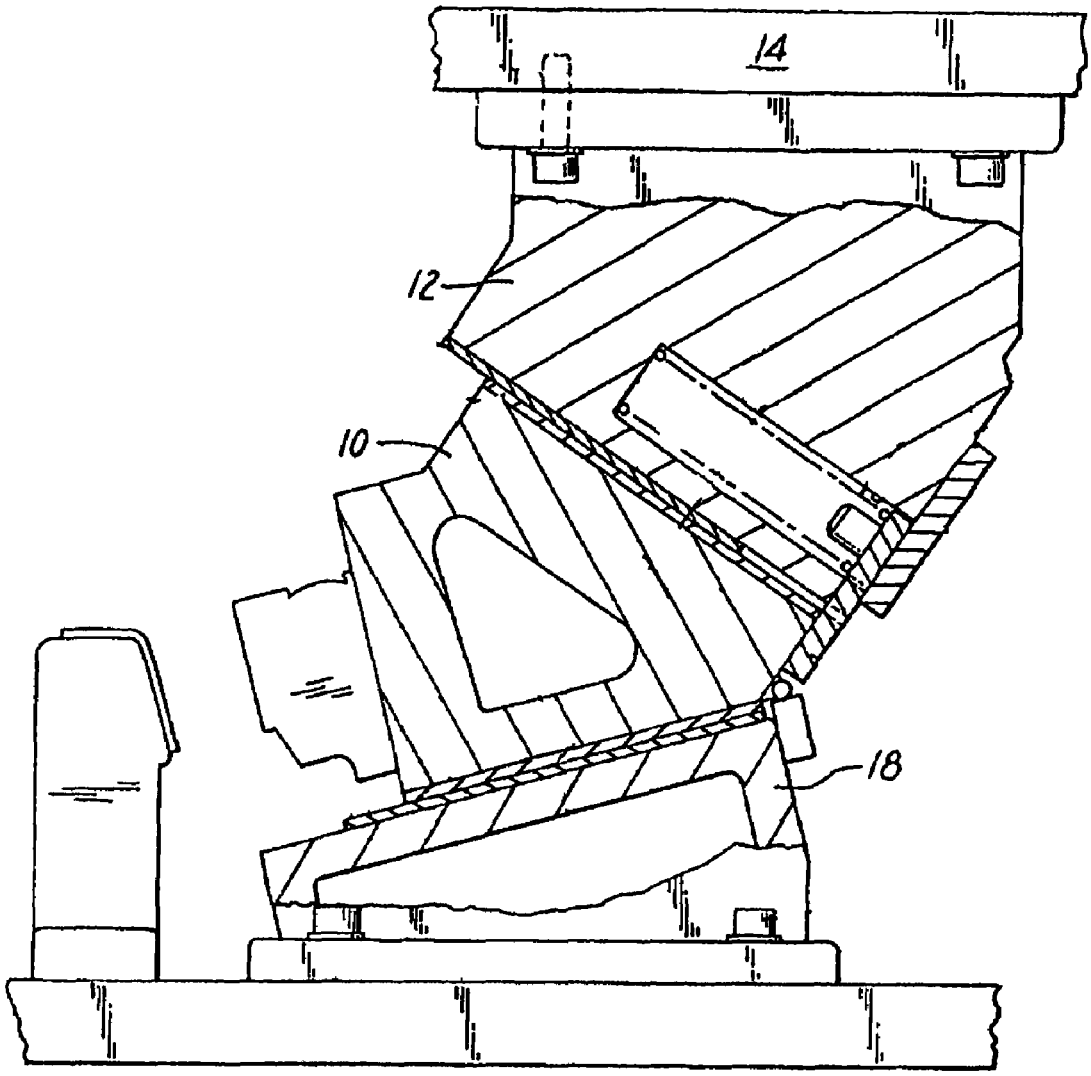
FIG. 7 PRIOR ART
FIG. 7 depicts a prior art aerial cam on which embodiments of the invention may be employed.

As mentioned above, adjusting the tool or tools 24 as shown in the —521 patent or as shown in FIGS. 1 and 2 of this application (the same reference numerals are used in this disclosure as are used in the —521 patent to illustrate similar parts) when the press is closed—and the tools are thus in contact with the workpiece—has been a trial and error procedure. To solve the problem I have conceived of a method and apparatus for simulating movement of the tool holder despite the fact the press is open and effecting adjustment of the tools 24 in relation to the workpiece. I accomplish this by detaching and removing the tool holder 10 from the cam adaptor 12 (see the structure in FIG. 7) and mounting the tool holder 10 on the driver 18.

In FIG. 1 of this disclosure, the tool holder 10 is depicted removed from the cam adapter (not shown) and is ready to be mounted on the driver 18. The double wear plates 38/52, 40/48, 42/50 and 44/54 are depicted ready to be nested together as the tool holder is lowered down on to the driver 18 to assume the positions shown in FIG. 5 of the —521 patent and FIGS. 2, 3 and 5 of the instant disclosure. While it is of course possible to move the tool holder manually toward and away from the workpiece, such does not simulate the movement of the tool holder when the press is in operation. When in operation the press causes the tool holder to move in a very precise manner, and then reverse direction and move back to its starting point. Therefore, to effect the simulated movement when being driven by the closing and opening of the press, I provide a mechanism which is connected between the driver and the tool holder which enables the die set-up operator to move the tool holder to simulate its action during press operation.

The arrangement is such that the tool holder is shifted on the driver while allowing the tool holder to "float" or find its own nested relationship on the driver. It will be noted that the double wear plates above mentioned are arranged in an inverted truncated "V" formation, with central wear plates 40/48 and 42/50 which are intended to carry the principal loading between the driver 18 and tool holder 10, and the guide plates along opposite edges of the central plates such as at 38/52 and 44/54 which serve to guide the tool holder during its reciprocation on the driver. The design is such that, as explained in the —521 patent, the tool holder and driver when initially set up, pass through a break-in phase where initially the loading is on the guide plates, but in time, as the plates wear down, the load is transferred to the central plates where the principal loading is intended to be taken. Accordingly, the tool holder and the driver have developed a nested relation determined by the way the plates have worn together, and this relationship should ideally be maintained during simulated movement of the tool holder during adjustment of the tools 24 thereon.

To allow the tool holder to float on the driver in its usual fashion, the mechanism for shifting the tool holder on the driver is so designed that it does not impose any unintended lateral or angular loading on the tool holder that would tend to deflect it from its habitual axis of travel. Thus, such mechanism comprises a straight bar or key 21 which is a slip fit in a slot 23 in the driver, and the key is locked securely therein by a pair of machine screws or the like 25 which are threaded into tapped holes in the bottom of the key slot 23. The slot 23 extends parallel to the wear plates above mentioned. One end of the key 21 extends beyond the driver as shown in FIG. 5 and opening outwardly axially of the key at such end is a threaded hole 27 for receiving an adjustment screw 29 shown in FIGS. 1, 4 and 5.

Figure 4:
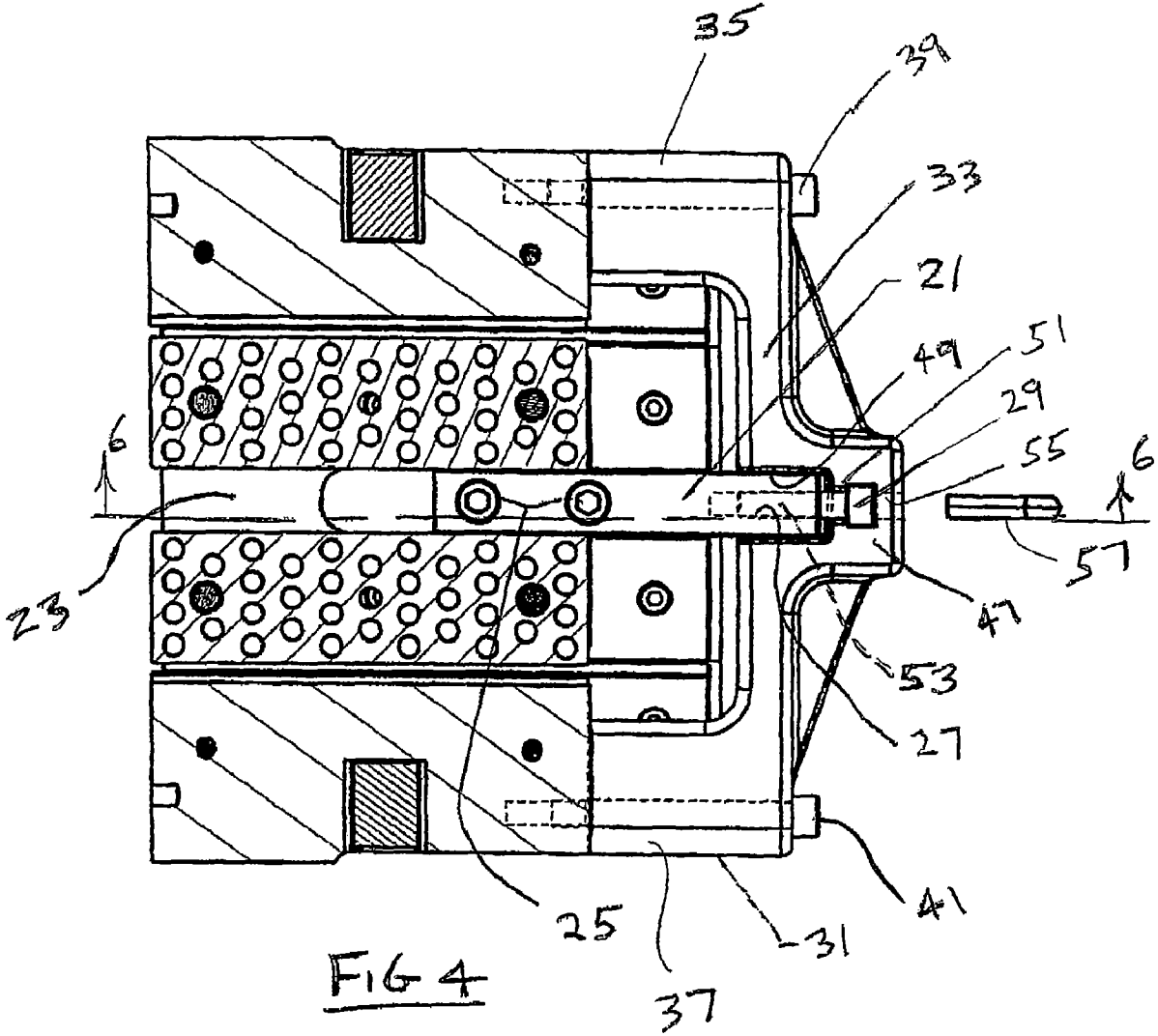
FIG. 4 is a cross-sectional view taken on the line 4-4 of FIG. 2.
Figure 5:
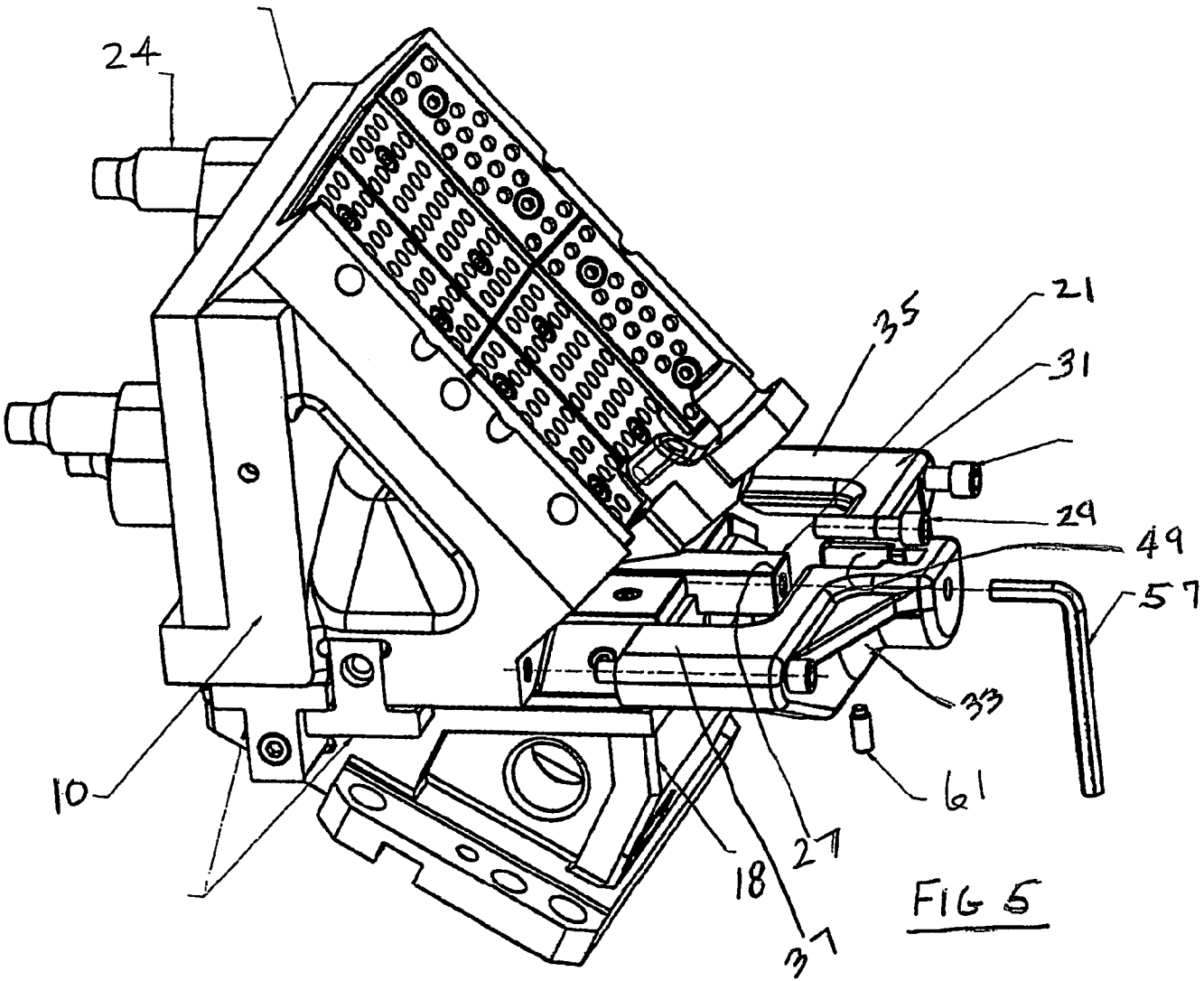
FIG. 5 is a perspective view of the tool holder and driver of an aerial cam with the apparatus for simulating movement of the tool holder ready for mounting on the tool holder and driver.
Figure 6:
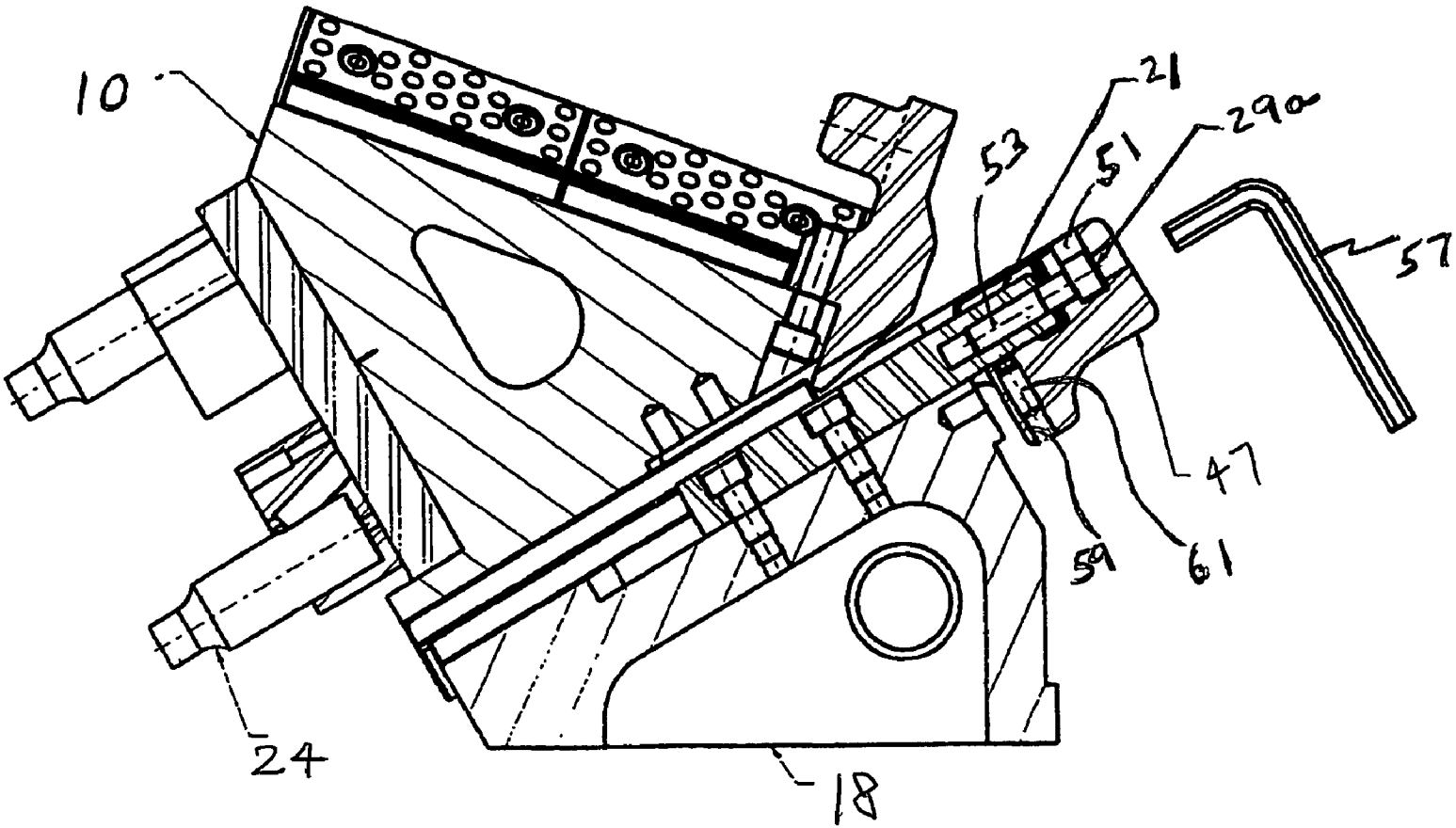
FIG. 6 is a cross-sectional view taken on the line 6-6 of FIG. 4.

A generally U-shaped bracket 31 having a bight portion 33 and a pair of parallel legs 35 and 37 is mounted on the tool holder with the ends of the legs abutting the tool holder as shown in FIG. 4. A pair of elongated screws 39 and 41 extend through the legs 35 and 37 and are received in threaded holes 43 and 45 in the tool holder 10 locking the bracket securely on the tool holder. Centered in the bight portion of the bracket is a boss 47 provided with a key receiving slot 49. The slot 49 is made larger than the key to provide clearance around the key and not impose any lateral pressure thereon which might affect the floating action of the tool holder on the driver. Also in the boss 47 is an extension 51 of the key slot, shaped to receive the head of the adjustment screw 29 and retain the screw against longitudinal shifting in the bracket while the threaded shank 53 of the screw is disposed in the threaded aperture 27 in the key 21. The end of the key slot extension opens outwardly through an aperture 55 to permit a driving tool such as an allen wrench or the like 57 to be fitted in the end of the adjusting screw to rotate it and in turn shift the tool holder on the driver to simulate the motion of the tool holder during normal operation of the press. In lieu of a manually operated tool 57, a motor driven tool may be used to speed up the movement of the tool holder.

To ensure that the tool holder 10 is nesting properly on the driver 18 and is not being, for example, lifted up slightly by the bracket and key, a threaded aperture 59 extends perpendicularly to the key, to receive a dog point set screw 61. By threading the set screw into the aperture and against the key, the bracket 31 will be pushed downwardly and in turn the tool holder will be pushed against the driver 18 to eliminate any gap that may exist between the opposed wear plates on the driver and tool holder.

The length of the legs 35 and 37 and the projection of the end of the key 21 from the slot 23, together with the length of the adjustment screw 29, are all selected so that upon rotation of the screw 29 as aforesaid, they will cause the tool holder 10 to move a distance sufficient to enable proper adjustment of the tools mounted on the tool holder in relation to the workpiece.

Thus, I have disclosed a method and apparatus for simulating the movement of the tool holder in an aerial cam which facilitates adjustment of the tools on the tool holder and substantially reduces the set up time. By rotating the adjustment screw 27 in first one direction and then the other, the movement of the tool holder may be exactly simulated so that the tools may be easily adjusted relative to the workpiece.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of facilitating adjustment of tools on a tool holder in an aerial cam without the presence of an upper die obstructing access to a die work area comprising:

removing the upper die from the die work area;

removing the tool holder from a cam adapter on an upper shoe of a press and mounting the tool holder on a driver for sliding movement as in normal operation of an aerial die;

mounting an installation bracket on the tool holder;

using a key to limit the movement of the bracket, thereby limiting movement of the tool holder on the driver shifting the tool holder toward and from a workpiece independent of the cam adapter to simulate the sliding action of the tool holder on the driver when the upper die closes and opens;

during such simulated sliding action of the tool holder adjusting the tools on the tool holder in relation to the workpiece; and remounting the tool holder on the cam adapter on the upper die.

2. The method of claim 1 characterized by connecting a tool holder actuator between the tool holder and the driver for moving the tool holder reciprocally on the driver to simulate the sliding action of the tool holder on the driver.

3. The method of claim 2 wherein said actuator comprises one portion connected to the tool holder and another portion connected to the driver and a third portion extending between the first and second portions and operable to shift the first portion relative to the second portion to move tools carried by the tool holder toward and away from a workpiece.

4. The method of claim 1 characterized by mounting the tool holder on the driver with opposed wearing surfaces of the tool holder and driver in full engagement whereby there are no gaps between such wear surfaces.

5. The method of claim 1 characterized by pushing the tool holder against the driver to urge opposed wear surfaces thereof toward each other to eliminate gaps therebetween.

6. An apparatus for simulating the sliding action of a tool holder on a driver in an aerial cam when dies of the aerial cam are open thereby facilitating adjustment of tools on the tool holder in relation to a workpiece, comprising:

an installation bracket for securement to the tool holder;

a key for attachment to the driver and in cooperation with the installation bracket to limit movement of the tool holder on the driver;

an adjustment member for connecting the key to the installation bracket; and the adjustment member controllably shifting the tool holder toward and from a workpiece simulating the action when a cam adapter on an upper die slidably shifts the tool holder on the driver.

7. The apparatus of claim 6 characterized by said adjustment member comprising a threaded part rotatably threadedly connected to one of said key and bracket and operable upon rotation to shift the tool holder on the driver to simulate normal operation of the tool holder on the driver.

8. The apparatus of claim 6 wherein said key overlies said bracket, and an adjustment member cooperates with the bracket and key to urge the key away from the bracket to push the tool holder against the driver and eliminate gaps between opposed wear surfaces thereof.

* * * * *